United States Patent [19]

Plath

[11] Patent Number: 4,995,487

[45] Date of Patent: Feb. 26, 1991

[54] WHEELED SUITCASE AND LUGGAGE SUPPORT

[76] Inventor: Robert V. Plath, 3030 NE. 44th St, Lighthouse Point, Fla. 33064

[21] Appl. No.: 390,960

[22] Filed: Aug. 8, 1989

[51] Int. Cl.[5] ..... A45C 5/14; A45C 13/30; A45C 13/38

[52] U.S. Cl. ..... 190/18 A; 190/108; 190/111; 190/115

[58] Field of Search ..... 190/18 A, 110, 115–117, 190/39; 150/108; 280/37

[56] References Cited

U.S. PATENT DOCUMENTS

| | | | |
|---|---|---|---|
| 2,581,417 | 1/1952 | Jones | 190/18 A X |
| 3,199,643 | 8/1965 | Korchmar | 190/110 X |
| 3,257,120 | 6/1966 | Browning | 190/18 A X |
| 3,306,404 | 2/1967 | Yellin | 190/110 |
| 3,606,372 | 9/1971 | Browning | 190/115 X |
| 3,917,038 | 11/1975 | Foge et al. | 190/18 A |
| 4,087,102 | 5/1978 | Sprague | 190/18 A X |
| 4,256,320 | 3/1981 | Hager | 190/18 A X |
| 4,261,447 | 4/1981 | Arias et al. | 190/18 A |
| 4,411,343 | 10/1983 | Cassimally et al. | 190/18 A |
| 4,616,379 | 10/1986 | Lio | 190/117 X |
| 4,618,035 | 10/1986 | Mao | 190/18 X |
| 4,759,431 | 7/1988 | King et al. | 190/18 A |
| 4,792,025 | 12/1988 | Thomas | 190/18 A |

FOREIGN PATENT DOCUMENTS

| | | | |
|---|---|---|---|
| 3328063 | 2/1985 | Fed. Rep. of Germany | 190/18 A |
| 2409720 | 7/1979 | France | 190/18 A |
| 2538229 | 6/1984 | France | 190/18 A |
| 1539021 | 1/1979 | United Kingdom | 190/18 A |
| 2168035 | 6/1985 | United Kingdom | 190/18 A |

*Primary Examiner*—Sue A. Weaver
*Attorney, Agent, or Firm*—Malin, Haley, McHale, DiMaggio & Crosby

[57] ABSTRACT

A luggage assembly comprising a suitcase having integrally connected thereto a laterally extendable handle at its upper end and a wheel assembly at its lower end is disclosed. To effect transport, the handle is moved from a lowered, compact, position to a raised position and the suitcase is tilted from an upright standing position to a canted position in which it is supported solely by its wheels and rolled by pulling said handle. An attachment allows for additional luggage items to be carried by the assembly and transported in a fully balanced manner.

14 Claims, 8 Drawing Sheets

WHEELED SUITCASE AND LUGGAGE SUPPORT

FIELD OF THE INVENTION

This invention relates generally to portable luggage and in particular to a rollaboard, carry-on-size suitcase with built in wheels and a retractable, friction-locking handle.

DESCRIPTION OF THE PRIOR ART

Portable luggage using four roller-type wheels and a flexible strap type handle is well known in the art. However, this type of bag has proven awkward, bulky, and unbalanced with respect to irregularities in ground surfaces. Furthermore, this type of luggage is too large to be carried into the passenger cabin of a commercial airline jet to be stowed away under the seat or in the overhead compartment. Consequently, these bags must be checked, thereby creating the possibility of checked luggage not arriving at the final destination at the same time as the passenger, or being damaged or lost.

In another alternative, one may stack baggage pieces on a dolly-type cart, also well-known in the art, and secure the bags with a bungee type cord. However, when passing through the security area, the entire load must be disassembled and individually placed on the security belt and then reassembled to continue to the gate. Furthermore, when boarding the aircraft, the cart and its contents must then be again disassembled to stow away all bags for flight. When exiting the aircraft, the cart must again be loaded and secured with the bungee cord. The use of this cart alternative creates an unnecessary nuisance in the repetitive loading and unloading of the luggage. The use of a separate cart introduces an additional piece of luggage for which the passenger must account, thereby making the cart itself a burden.

SUMMARY OF THE INVENTION

The rolling commuter bag of the present invention solves these problems encountered by the prior art by the provision of a novel retractable handle and a pair of rollers in a one-piece carry-on suitcase which allows for convenient and smooth manipulation by a traveler.

The present invention is directed to a commuter suitcase of unitary design containing a novel retractable handle arrangement and two recessed roller wheels on the underside portion thereof which effectively facilitates an efficient and convenient means for transporting one's personal belongings while traveling. The handle assembly contains an offset guide means connected to the interior of the suitcase into which is disposed, in sliding telescoping relationship, the main handle which becomes lodged by friction against said offset guide means when in the extended position.

The rolling mechanism is comprised of a dual wheel assembly which is preferably recessed into the lower posterior side of the suitcase, thereby not substantially altering the dimensions of the interior or exterior of the suitcase. In order to transport the suitcase, the handle is first extended into the raised position and then tilted downward at approximately a 30 degree angle from vertical to tip the suitcase onto the rollers bringing a pair of ground engaging support feet out of contact with the ground and thereby allowing the wheels to rotate freely as the user walks at a normal pace. The unique design further allows for a flight or shoulder bag to be carried on top thereof. An attachment kit makes it possible to carry up to four luggage items piggyback style in a fully balanced manner.

OBJECTS OF THE INVENTION

It is therefore an important object of the present invention to provide a convenient suitcase of an efficient ergonomic design such that one's travel belongings can be transported in a convenient manner.

Another object of the present invention is the provision of a travel suitcase with a laterally extendable handle which functions via an offset guide means engaging said extendable handle in a guide tube to effectively lock the handle in an extended, in use, position.

A further object of the present invention is the provision of a rolling luggage item having an extendable and retractable handle and a rolling wheel assembly which is recessed within the underside portion of the suitcase body so as not to appreciably increase the dimensions of the suitcase.

Still another object of the present invention is to provide a luggage item which can be readily maneuvered through the aisle of a commercial aircraft or the like and which meets F.A.A. size restrictions for carry-on articles to be stowed in the overhead compartment or under a passenger seat.

And still a further object of the present invention is to provide a compact rolling commuter baggage article which allows for up to four luggage items to be carried thereon in a fully balanced manner.

Other objects and advantages of the present invention will become apparent when the portable suitcase of the present invention is considered in conjunction with the accompanying drawings. The bag essentially becomes a cart itself for carriage of other luggage items.

DETAILED DESCRIPTION OF THE PREFERRED EMBODIMENT

Figure 1:
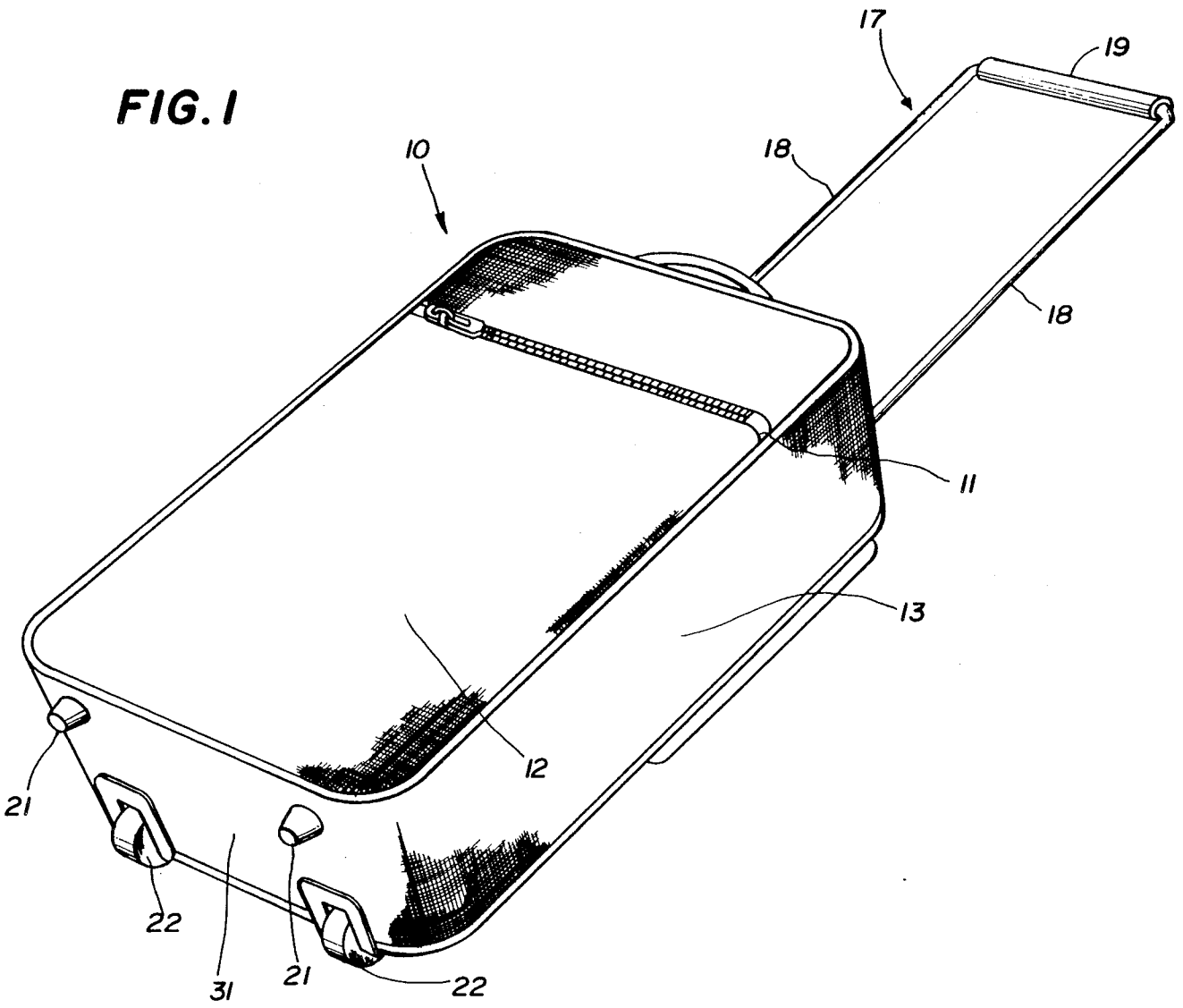
FIG. 1 is a front perspective view of an article of luggage in accordance with the present invention.
Figure 2:
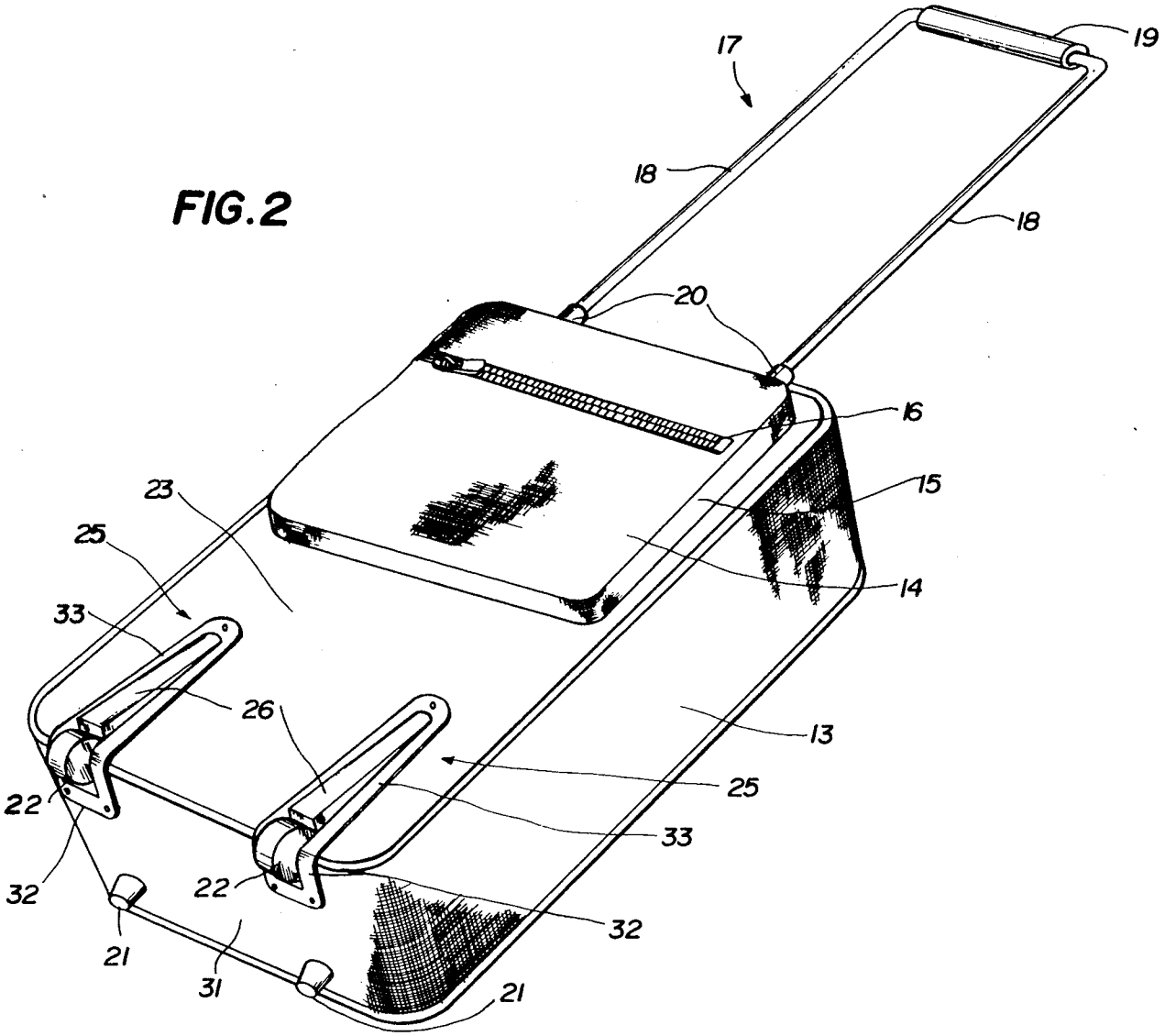
FIG. 2 is a rear perspective view of the article of luggage as illustrated in FIG. 1.

As shown in FIGS. 1 and 2, the article of luggage 10 of the present invention is comprised of a soft sided suitcase body 13 and a generally U-shaped handle member 17 slidably disposed therewith, said handle consisting of a pair of slidable handle rods 18 and a gripping means 19, disposed between the two rods 18 for manipulating the handle member 17 and consequently the suitcase body 13. The present invention is particularly oriented for use on luggage having two or more roller type wheels 22 or the like on which the luggage can be rolled across a supporting surface when the suitcase 10 is tilted to a canted position on the wheels 22.

Figure 3:
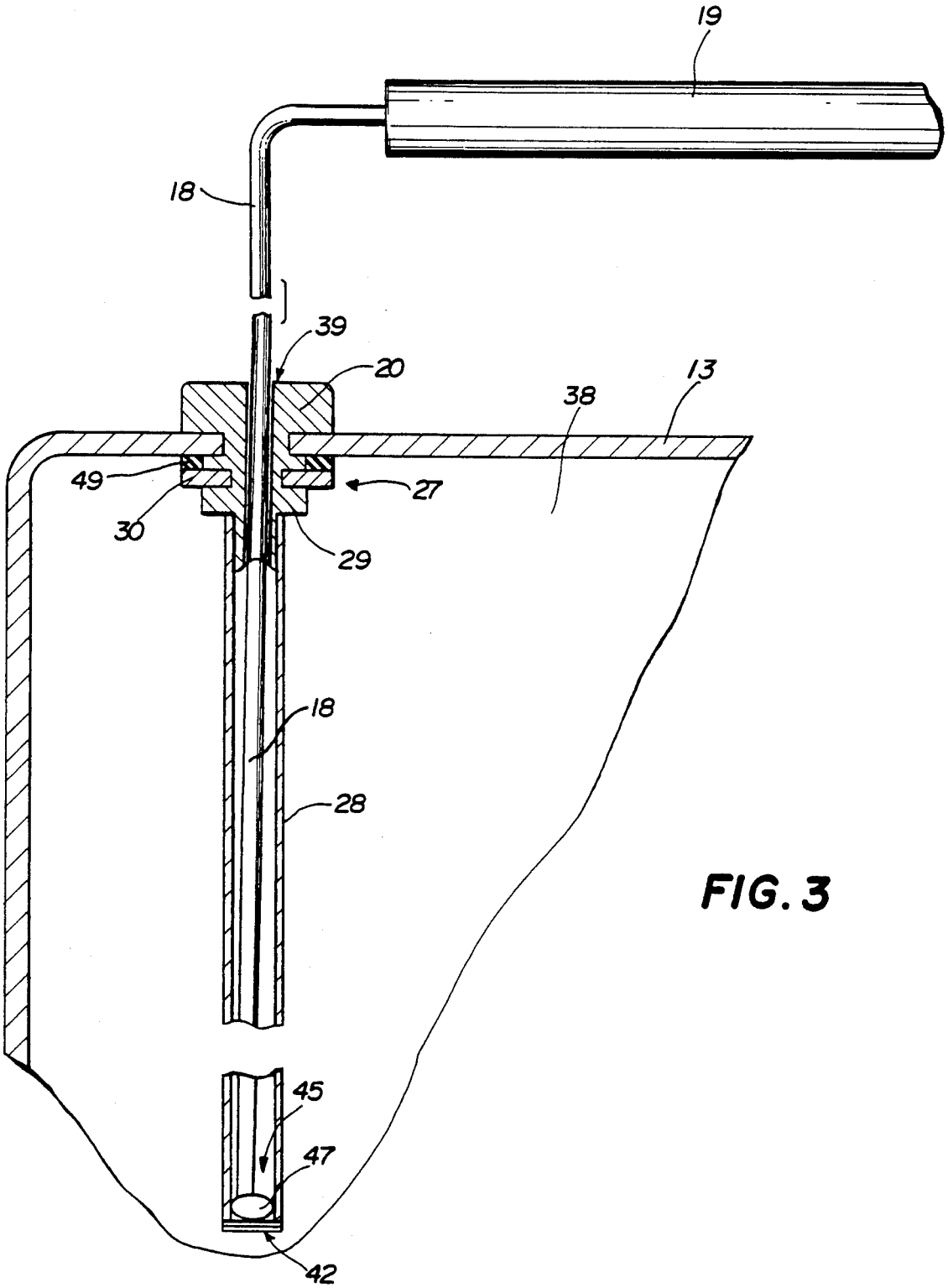
FIG. 3 is a partial elevational view of the suitcase showing the handle assembly in a retracted position.
Figure 4:
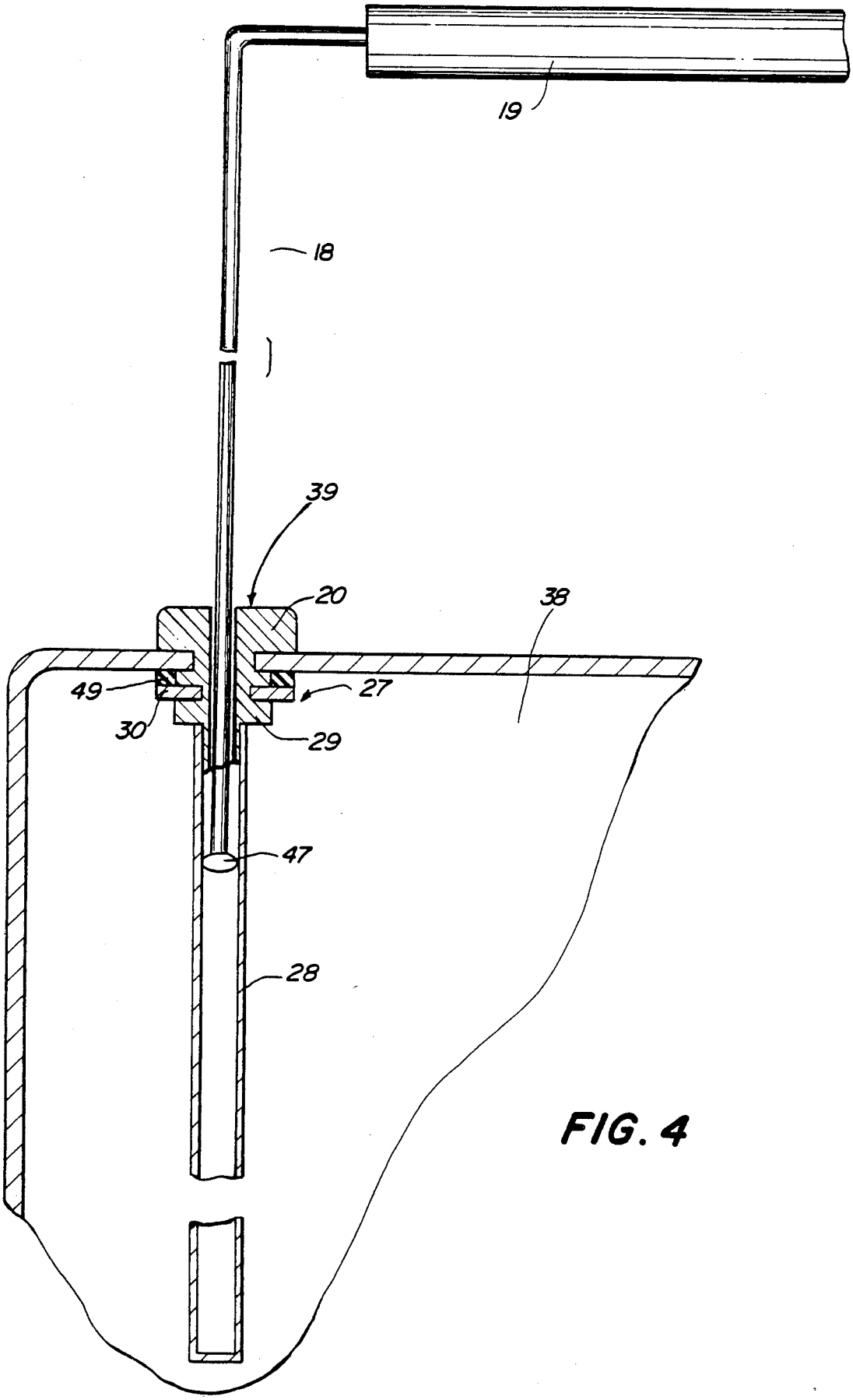
FIG. 4 is a partial elevational view of the suitcase showing the handle assembly in an extended position.
Figure 5:
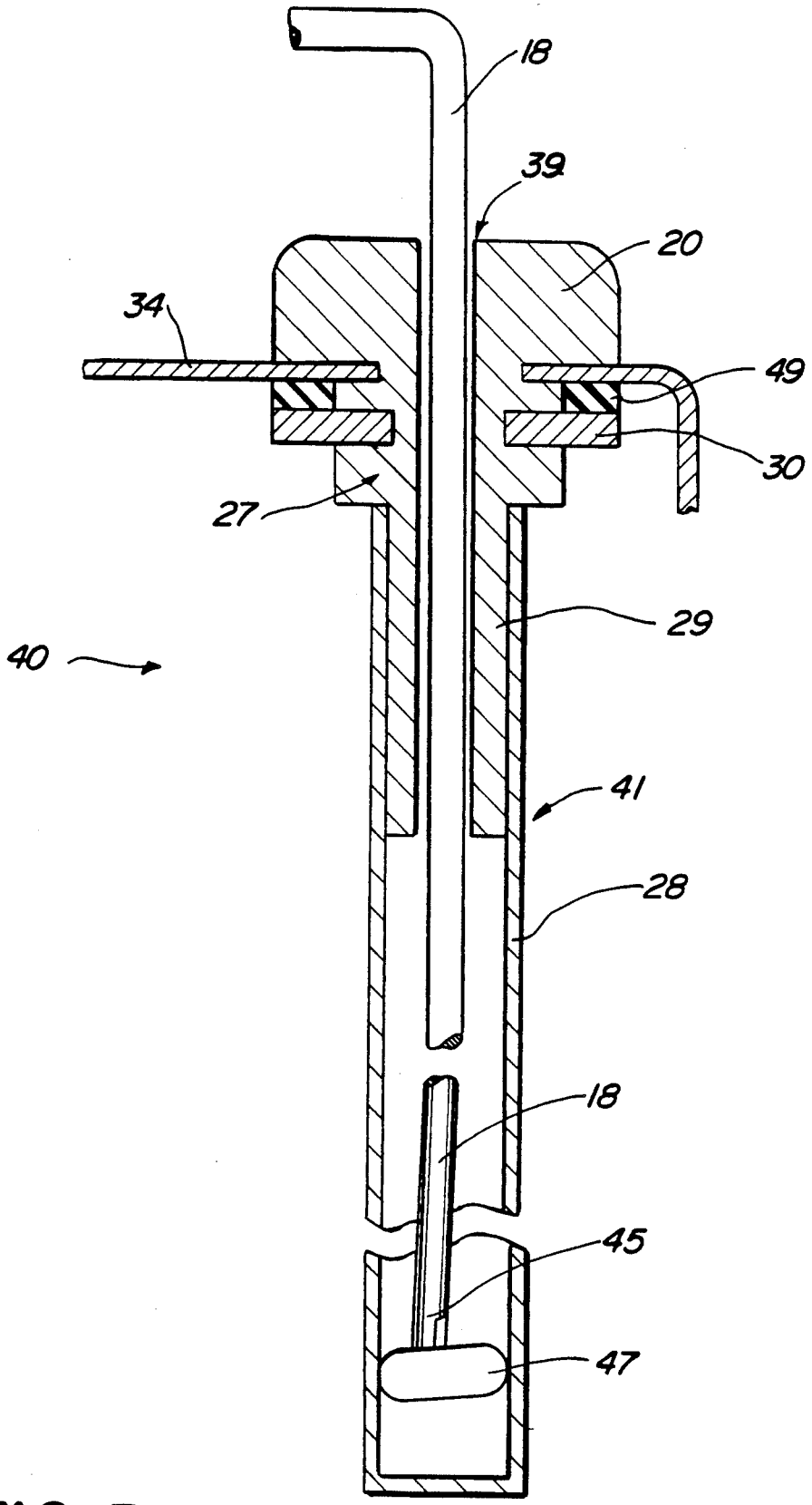
FIG. 5 is an enlarged view of the handle assembly.

The handle member 17 is slidably mounted to the body portion 13 of the suitcase 10. A pair of insertion guide means 20 of Delrin plastic or other suitable material are disposed within receiving apertures located on the upper lateral face panel 34 of the suitcase body 13. A pair of insertion guide bushing means 27 ensure a secure and trim looking fit and allow for symmetrical entry of the slidable U-shaped handle member 17 within a handle guide and retainer assembly 40 disposed within the confines of the interior of the suitcase body 13. As best shown in FIGS. 3–5, the U-shaped handle member 17 is slidably disposed partially within nylon guide bushing means 27. The bushing 27 is comprised of a generally cylindrical body member 29 having an aperture 39 therethrough, mounted to the suitcase body 13 by a snap ring 30 and support washer 49 which washer may be threadably attached to cylindrical body member 29 and spreads any loads imposed upon guide means 27 across a larger area of suitcase member 13 is well known in the art. The upper or head end 20 of guide bushing means 27 doubles as a trim ring to cover the aperture (not shown) in suitcase body 13 through which is disposed said shafts 18 of handle 17. The lower terminal end 41 of the guide bushing means 27 is disposed within a sleeve member 28 in coaxial association. Rod 18 of U-shaped member 17 is disposed in slidable association within sleeve 28. Sleeve 28 has an inner diameter substantially larger than the outer diameter of rod 18 such that it allows for the rod 18 to slide freely during the extension and retraction process.

The sleeve 28 is of a length such that the lower terminal portion 45 of rod 18 is fully encompassed thereby when the handle member 17 is in its fully retracted position. The lower terminal portion 45 of rod 18 is provided with an offset guide means 47 which is comprised of nylon or the like. The offset guide means 47 is preferably a cylindrical disk coinciding generally with the inner diameter of sleeve 28. Rod 18 is fixedly connected at its lower end slightly offset from, or non-coaxial with, the central axis of cylindrical guide means 47. That is, the elongate central axis of rod 18 does not pass thru the central axis of disc-like offset guide means 47. This arrangement causes rod 18 to be slightly curved with respect to the elongate axis of sleeve 28. This arrangement causes a friction type locking arrangement when handle 17 is in the retracted or extended positions shown in FIGS. 3 or 4.

To effect extension of the handle 17, gripping means 19 may be grasped and pulled upwardly. When the handle 17 has reached its maximum extension, the offset guide means 47 wedge the lower end segment of rod 18 against sleeve 28 and bushing means 27, binding said handle 17 frictionally in position for use as clearly shown by FIG. 4.

The user may then grasp the gripping means 19 and tilt the handle downward, for example approximately 30 degrees from vertical, to tip the suitcase onto its roller wheels 22, allowing the user to pull and roll the piece of luggage across a supporting surface. To retract the handle 17, downward pressure is applied to the gripping means 19 sufficient to overcome the friction force of rod 18 against the inner through-bore of bushing means 27 and sleeve 28, forcing the offset guide means 47 downward and out of its jammed position at the head of sleeve 28 and into the lower area L of sleeve member 28. In the preferred embodiment, rod 18 is slightly bent within sleeve 28 in all positions of offset guide means 47 so that at least a portion of rod 18 bears frictionally against bushing means 27.

Figure 8:
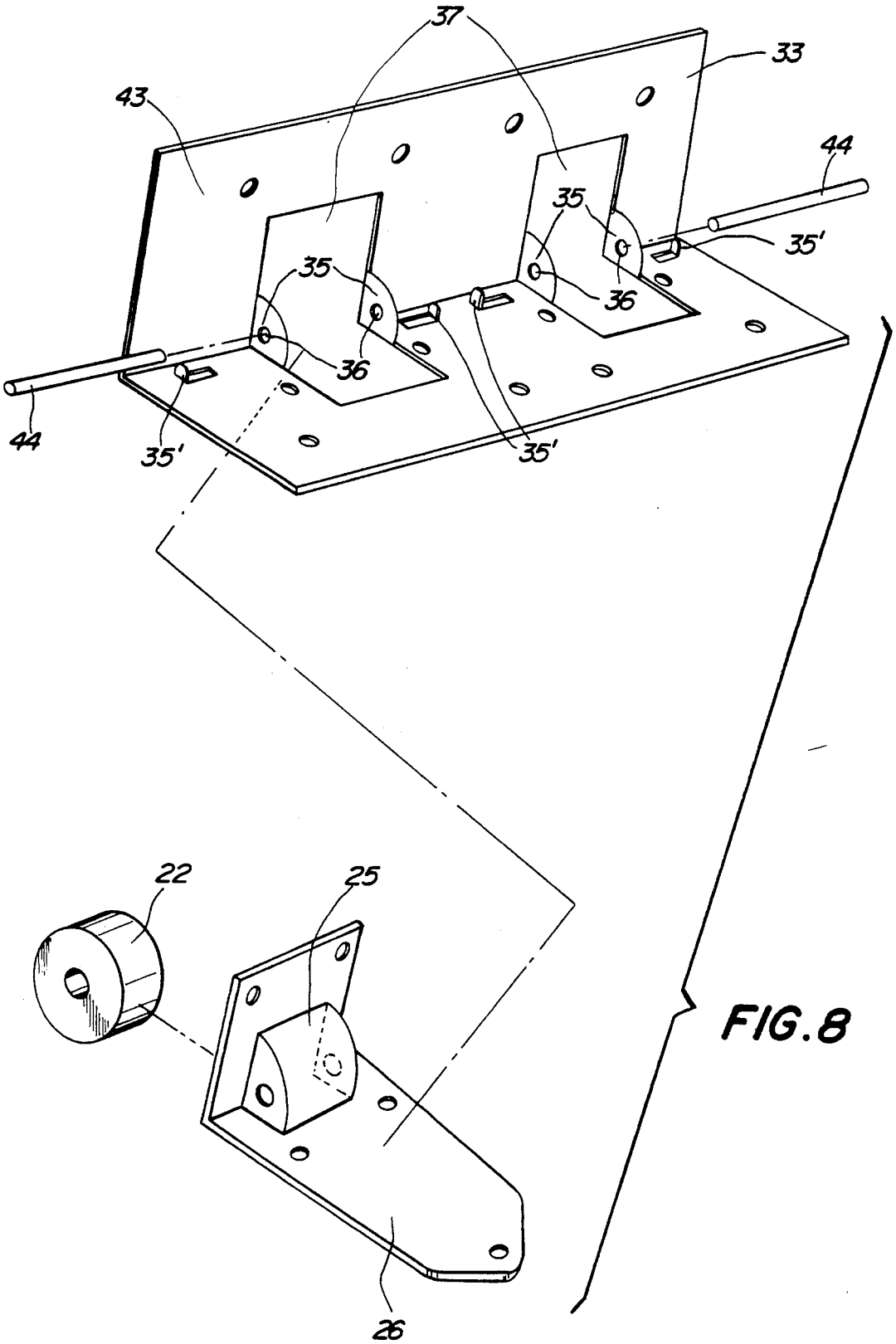
FIG. 8 is an exploded view of the roller wheel attachment means.

Two roller type wheels 22 are disposed on the bottom lateral face panel 31 of the main body compartment 13 in the preferred embodiment. The fixed roller members 22 are journaled by rotation shafts 44 mounted on a rigid support plate 43 shown in FIG. 8. The support plate 43 is preferably equipped with retaining tab means 35 having an aperture 36 through which the rotation shafts 44 are inserted. Outer retaining tab means 35' are punched from support plate 43, as shown in FIG. 8, and bent upwardly to contact and retain the ends of shafts 44 thereby retaining the wheels 22 in place. Openings 37 in the support plate 43 are provided such that the roller wheels 22 are accepted therein. The support plate 43 is mounted on the interior body portion 38 of the suitcase 13 such that the vertical plate section 33 is oriented flush against the rearward vertical face panel 23 of the suitcase and the horizontal plate section 32 is flush against the bottom lateral face panel 31 of the suitcase. The support plate 43 is attached to the body compartment 13 by any conventional means known in the art. The roller wheels 22 are thus oriented such that only a small amount of each roller 22 at any given time is located outside the interior compartment of the luggage item. FIG. 2 clearly shows the roller wheels 22 mounted in their defined position. The rearward vertical face panel 23 is further provided with wheel wells 25 which encompass the wheel assemblies 22 on the exterior face panels 23 and 31 and form the inside surface portion of the interior compartment in the vicinity of the wheels. A protective flange 26 is disposed on each wheel well 25 to reduce damage to the exterior vertical face panels 23 and 12 should the suitcase be dropped, dragged or pushed over. Flange 26 also allows for riding smoothly up over a curb without damage to the fabric or surface of the suitcase 13. The bottom lateral face panel 31 is additionally provided with two foot studs 21 which perform both balance and support functions when the suitcase 10 is in its upright stationary position.

The upper and lower panels of the suitcase 13 are preferably reinforced to lend support and stability thereto.

The exterior and interior vertical face panels are provided with a plurality of pockets which can enclose such items as umbrellas, passes, schedules, keys, manuals, magazines, hat, gloves, or any such item which the typical traveler would need quick and easy access to while en route to his or her destination. There is incorporated in the present invention an expandable pleated type pocket 14 disposed on the rear vertical face panel 23. It is accessed by means of a zipper 16 which may be oriented in a horizontal direction. The pleated side wall portion 15 of pocket 14 allows for expansion of the pocket's effective volume capacity such that large items may be encompassed within the confines of the pocket 14.

Figure 6:
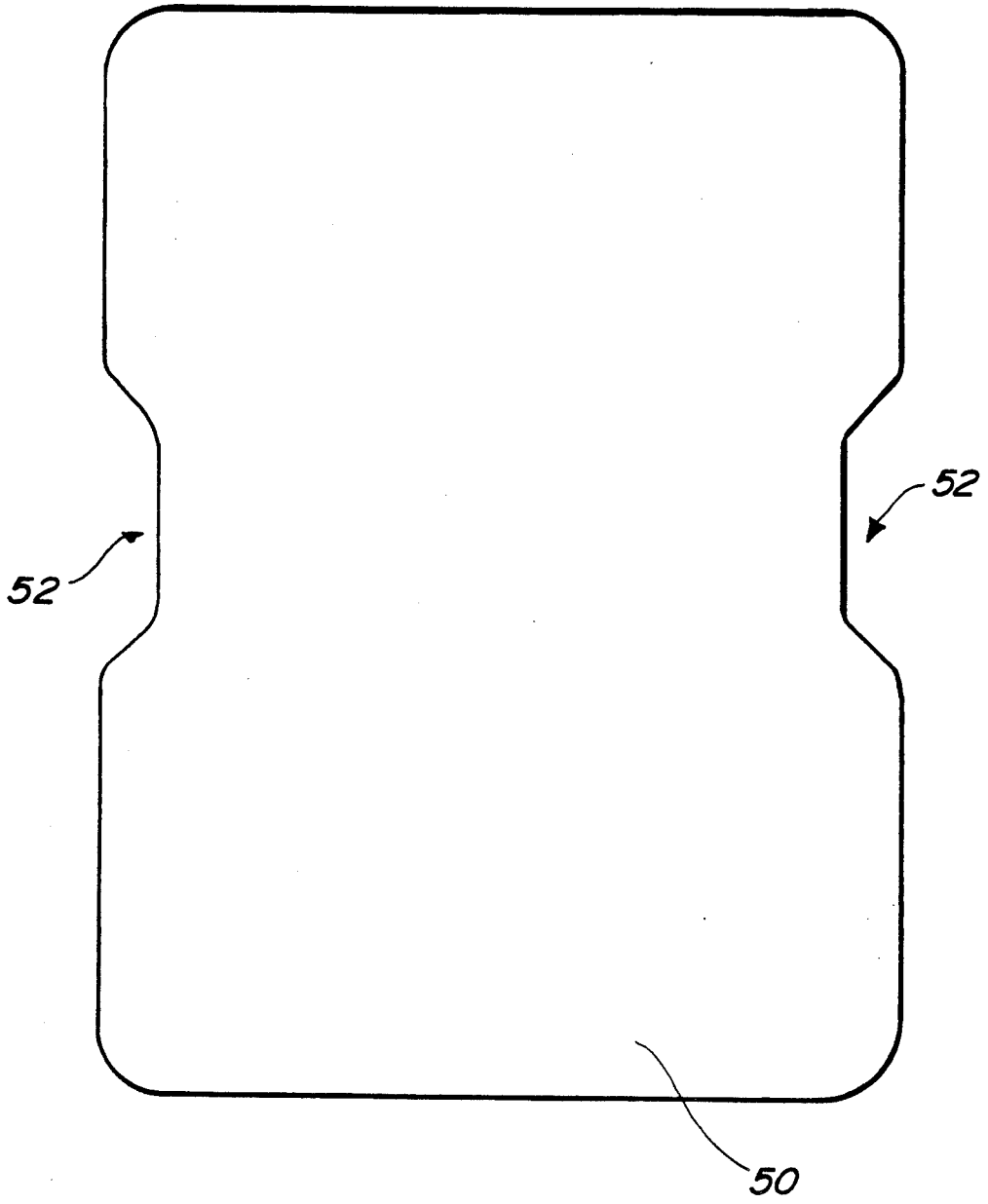
FIG. 6 is a top view of the divider shelf.

The luggage item of the present invention is provided with a conventional type access means to access the interior compartment 38. In the preferred embodiment a zipper 11 permits the front vertical face panel 12 to be folded away such that the interior 38 is exposed and can be easily loaded or unloaded. Within the interior compartment 38, a divider shelf 50 with hand cutouts 52 is provided to create a means for organization and reduce chaos of the contents when the suitcase is accessed (see FIG. 6). The hand cutouts 52 provide ease in inserting and removing the shelf 50.

The present design allows for convenient stowage of the suitcase 10 in either the overhead compartment or under the seat of a commercial aircraft such that it is recognized by the F.A.A. as a carry-on bag and may be utilized as such. In one embodiment the dimensions of 22½ in. in length by 14½ in. in width by 8 in. in depth are described. However, any other size dimensions which are within the scope of the present invention are contemplated.

Figure 7:
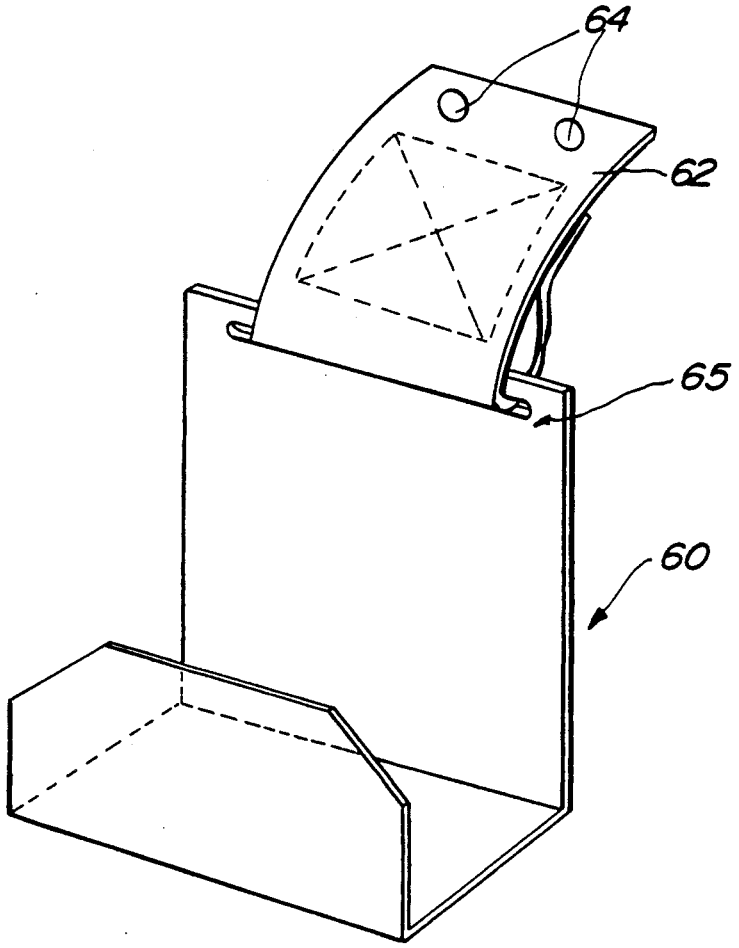
FIG. 7 is a perspective view of the optional attachment assembly which allows for transport of additional luggage items.

FIG. 7 shows a generally J-shaped hook member 60 for removably connecting additional items to suitcase 13 for transport. A flexible strap means 62 is connectable by snaps 64 to suitcase 13, said strap means 62 being looped through a slot 65 in said hook member 60.

In one embodiment, the suitcase 13 is a conventional carry-on size soft-sided article. The soft-sided bag is advantageous because it is flexible and can therefore hold additional items if caused to bulge. Additional items can be stored in nooks and crannies caused by bulging.

It will be understood that this invention is not to be limited by the details given herein but that it may be modified within the scope of the appended claims.

What is claimed is:

1. A wheeled suitcase and luggage support comprising:

a body portion a plurality of roller type wheels partially recessed within said body portion, a generally U-shaped handle having a means for gripping said handle and having two essentially parallel spaced elongated rod members, said rod members each having an axial center line and being slidably retractable between an extended and a retracted position within said body portion, a locking means for said U-shaped handle comprising means inside said body portion for receiving said rod members of said handle, and a pair of guides, one each attached to the lowermost end of each of said rod members, said guides being offset with respect to the axial centerline of said rod members of said U-shaped handle, said guides causing said rod members to frictionally engage said means for receiving whereby said handle remains in any position with respect to said body portion that the user places it in between said extended and retracted position of said handle.

2. The wheeled suitcase and luggage support of claim 1, wherein the dimensions of said wheeled suitcase and luggage support are such that said wheeled suitcase and luggage support can be rolled and/or carried aboard the passenger cabin of a commercial aircraft such that said wheeled suitcase and luggage support can be contained within the confines of the overhead compartment of said passenger cabin.

3. The wheeled suitcase and luggage support of claim 2, wherein said dimensions are 22½ in. in length by 14½ in. in width by 8 in. in depth.

4. The wheeled suitcase and luggage support of claim 2 wherein said means for receiving comprise two cylindrical sleeve members, each being coaxially and integrally connected, at its upper end, to a bushing assembly, said bushing assembly rigidly connected to said suitcase and defining an aperture through which said rod members are slidably disposed.

5. The wheeled suitcase and luggage support of claim 4 further comprising means for carrying additional luggage items thereon.

6. The wheeled suitcase and luggage support of claim 5, wherein said means for carrying additional luggage items is comprised of a generally J-shaped hook member having an outer upstanding lip member adapted to removably engage an additional item to be transported, said additional item being generally supported by said suitcase, said hook member being removably connectable to said suitcase by means of a flexible strap.

7. The wheeled suitcase and luggage support of claim 5 further comprising a removable divider shelf within said body portion.

8. The wheeled suitcase and luggage support of claim 7 wherein said body portion further comprises an expandable outer pocket on the exterior sidewall of said body portion, said exterior sidewall being recessed at one end to receive said plurality of roller type wheels, said expandable outer pocket being capable of holding additional items.

9. The wheeled suitcase and luggage support of claim 1 wherein said means for receiving comprise two cylindrical sleeve members, each being coaxially and integrally connected, at its upper end, to a bushing assembly, said busing assembly rigidly connected to said suitcase and defining an aperture through which said rod members are slidably disposed.

10. The wheeled suitcase and luggage support of claim 9 further comprising means for carrying additional luggage items thereon.

11. The wheeled suitcase and luggage support of claim 10, wherein said means for carrying additional luggage items is comprised of a generally J-shaped hook member having an outer upstanding lip member adapted to removably engage an additional item to be transported, said additional item being generally supported by said suitcase, said hook member being removably connectable to said suitcase by means of a flexible strap.

12. The wheeled suitcase and luggage support of claim 10 further comprising a removable divider shelf within said body portion.

13. The wheeled suitcase and luggage support of claim 8 wherein said body portion further comprises an expandable outer pocket on the exterior sidewall of said body portion, said exterior sidewall being recessed at one end to receive said plurality of roller type wheels, said expandable outer pocket being capable of holding additional items.

14. The wheeled suitcase and luggage support of claim 1, wherein said body portion is a soft sided suitcase.

* * * * *